US008444536B2

(12) United States Patent
Shifferaw

(10) Patent No.: US 8,444,536 B2
(45) Date of Patent: May 21, 2013

(54) WEIGHTLIFTING SYSTEM FOR DOING ARM CURLS

(76) Inventor: Tessema Dosho Shifferaw, Albany, CA (US)

( * ) Notice: Subject to any disclaimer, the term of this patent is extended or adjusted under 35 U.S.C. 154(b) by 1522 days.

(21) Appl. No.: 11/048,427

(22) Filed: Feb. 1, 2005

(65) Prior Publication Data

US 2005/0192166 A1 Sep. 1, 2005

Related U.S. Application Data

(63) Continuation-in-part of application No. 10/600,216, filed on Jun. 19, 2003, now Pat. No. 7,018,325.

(51) Int. Cl.
*A63B 21/00* (2006.01)

(52) U.S. Cl.
USPC ..... 482/94; 482/108; 482/106; 482/98

(58) Field of Classification Search
USPC ..... 482/97, 94, 98–104, 106–108
See application file for complete search history.

(56) References Cited

U.S. PATENT DOCUMENTS

| | | | | |
|---|---|---|---|---|
| 560,517 | A | 5/1896 | Metzger | |
| 3,268,224 | A | 8/1966 | Freshour | |
| 4,205,838 | A * | 6/1980 | McIntosh | 482/106 |
| 4,369,966 | A * | 1/1983 | Silberman et al. | 482/38 |
| 4,502,681 | A | 3/1985 | Blomqvist | |
| 4,529,198 | A | 7/1985 | Hettick | |
| 4,566,691 | A | 1/1986 | Mahnke | |
| 4,575,077 | A | 3/1986 | Osborne et al. | |
| 4,790,530 | A | 12/1988 | Maag | |
| 4,799,673 | A | 1/1989 | Selle | |
| 4,822,034 | A | 4/1989 | Shields | |
| 4,971,318 | A * | 11/1990 | Tracy | 482/107 |
| 5,060,939 | A | 10/1991 | Oswald et al. | |
| 5,116,297 | A | 5/1992 | Stonecipher | |
| 5,123,885 | A | 6/1992 | Shields | |
| 5,141,480 | A | 8/1992 | Lennox et al. | |
| 5,415,607 | A | 5/1995 | Carpenter | |
| 5,429,570 | A | 7/1995 | Beyer | |

(Continued)

FOREIGN PATENT DOCUMENTS

JP 8277983 A 10/1996

OTHER PUBLICATIONS

Cybex Commercial Strenth Systems, p. 41 Item5460 ,Scott curl Copy right 2000.*

Yukon Fitness Equipment, TK-400 Caribou II Gym, 1994-95 Catalog.

*Primary Examiner* — Jerome W Donnelly
(74) *Attorney, Agent, or Firm* — Edward S. Wright

(57) ABSTRACT

Weightlifting system for doing arm curls having a frame, a seat mounted on the frame for supporting a person using the system, a pair of posts extending upwardly and rearwardly from the front portion of the frame, an arm rest panel mounted on the posts in front of the seat for engagement by the upper arms of a person on the seat, a pair of weight stands positioned next to the legs in front of the arm rest panel, a bar extending between the weight stands in position to be grasped in the hands of a person sitting on the seat with the backs of the upper arms of the person resting against the arm rest panel, and a plurality of weight plates disposed on each of the stands for selective attachment to the bar.

16 Claims, 5 Drawing Sheets

U.S. PATENT DOCUMENTS 5,462,510 A 10/1995 Ish
5,484,367 A * 1/1996 Martinez ..... 482/107
5,630,776 A 5/1997 Yang
5,839,997 A 11/1998 Roth et al.
6,033,350 A 3/2000 Krull
6,039,678 A 3/2000 Dawson
6,149,558 A 11/2000 Chen
6,186,928 B1 2/2001 Chen
6,565,495 B2 5/2003 Slattery
6,682,464 B2 1/2004 Shifferaw
6,685,601 B1 2/2004 Knapp
2004/0259696 A1 12/2004 Shifferaw

* cited by examiner

FIG. 9
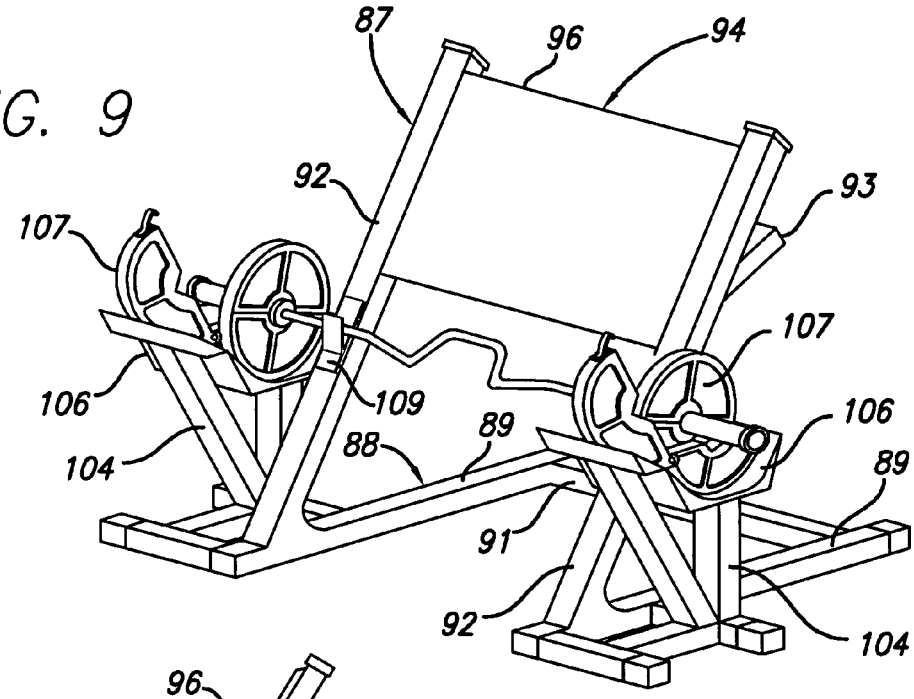
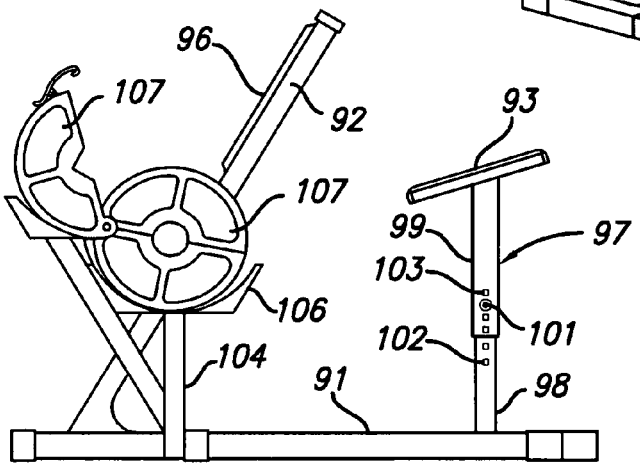
FIG. 10
FIG. 11
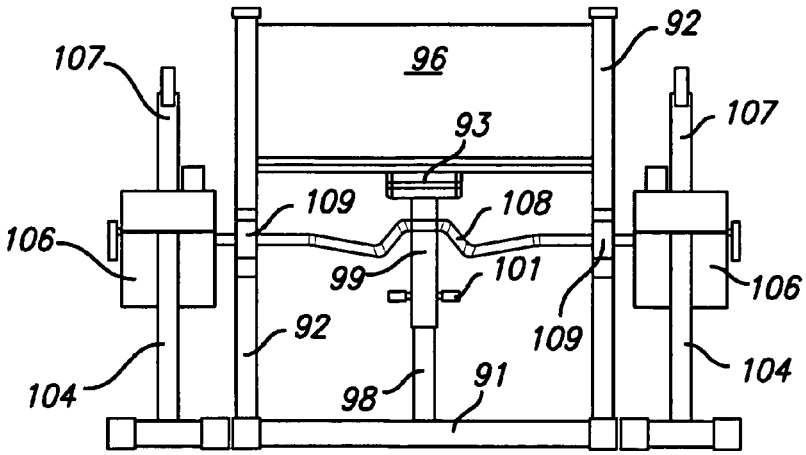

WEIGHTLIFTING SYSTEM FOR DOING ARM CURLS

RELATED APPLICATION

This is a continuation-in-part of application Ser. No. 10/600,216, filed Jun. 19, 2003 now U.S. Pat. No. 7,018,325.

BACKGROUND OF THE INVENTION

1. Field of Invention

This invention pertains generally to exercise and fitness equipment and, more particularly, to an improved weightlifting system which is particularly suitable for doing arm curls.

2. Related Art

Notwithstanding the numerous types of exercise and fitness equipment which have been developed in recent years, free weights or barbells still remain one of the most popular. Such devices typically consist of an elongated bar, a plurality of interchangeable weight plates which are mounted on the end portions of the bar, and collars which retain the weight plates in place.

Changing the weight on the bar requires removal of the outer collars, the lifting of weight plates onto and/or off of the bar, and replacement of the collars. This takes time and, in addition to being inconvenient, can be difficult for a smaller person who must remove the heavier plates left on the bar by a stronger prior user. Also, in handling weight plates, there is always a danger of personal injury or property damage if the plates are dropped or inadvertently banged together.

Another problem in the use of free weights arises when the lifter is doing exercises on a bench, with the bar above him. As the lifter does his exercise, he tends to tire, and a spotter is often required to help him lift the bar away from his body at the end of the exercise so he can get out from under it.

OBJECTS AND SUMMARY OF THE INVENTION

It is, in general, an object of the invention to provide a new and improved weightlifting system which is particularly suitable for doing arm curls.

Another object of the invention is to provide a weightlifting system of the above character which overcomes the limitations and disadvantages of systems heretofore provided.

These and other objects are achieved in accordance with the invention by providing a weightlifting system having a seat for supporting a person using the system, an arm rest having an upwardly and rearwardly inclined panel positioned in front of the seat for engagement by the upper arms of a person on the seat, a pair of weight stands positioned in front of and to the sides of the arm rest, a bar extending between the weight stands in position to be grasped in the hands of a person sitting on the seat with the backs of the upper arms of the person resting against the arm rest panel, and a plurality of weight plates disposed on each of the stands for selective attachment to the bar.

BRIEF DESCRIPTION OF THE DRAWINGS

FIG. 9 is an isometric view of an embodiment of a weightlifting system incorporating the invention which is particularly suitable for use in doing arm curls.

FIG. 10 is a side elevational view of the embodiment of FIG. 9.

FIG. 11 is a front elevational view of the embodiment of FIG. 9.

DETAILED DESCRIPTION

Figure 1:
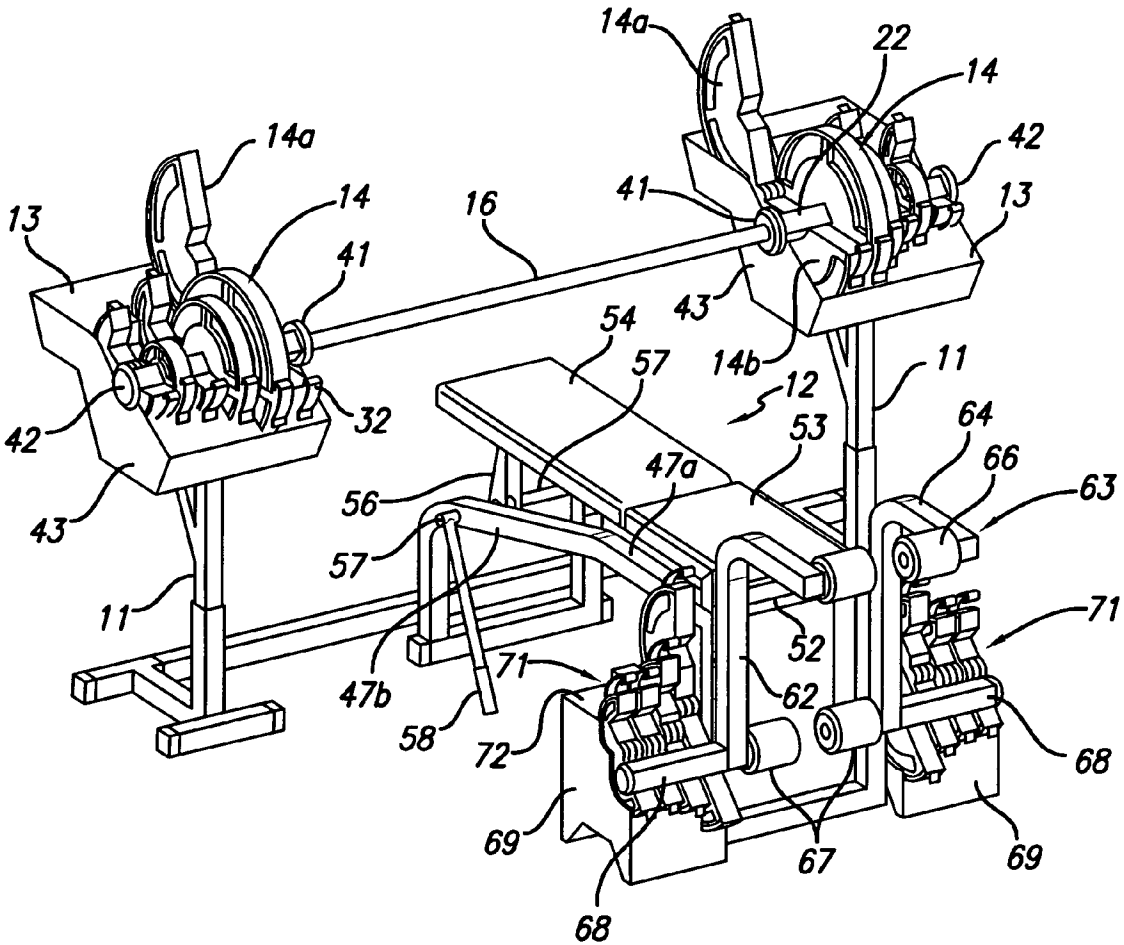
FIG. 1 is an isometric view of one embodiment of a weightlifting system incorporating the invention.

As illustrated in FIG. 1, the weightlifting system includes a pair of weight stands 11 which are positioned on opposite sides of a bench 12. A tray 13 at the top of each stand holds a plurality of weight plates 14 in an upright, side-by-side position for selective attachment to an elongated bar 16 which extends over the bench and between the stands. If desired, the weight stands can be made adjustable in height in order to adjust the rest position of the bar.

Figure 2:
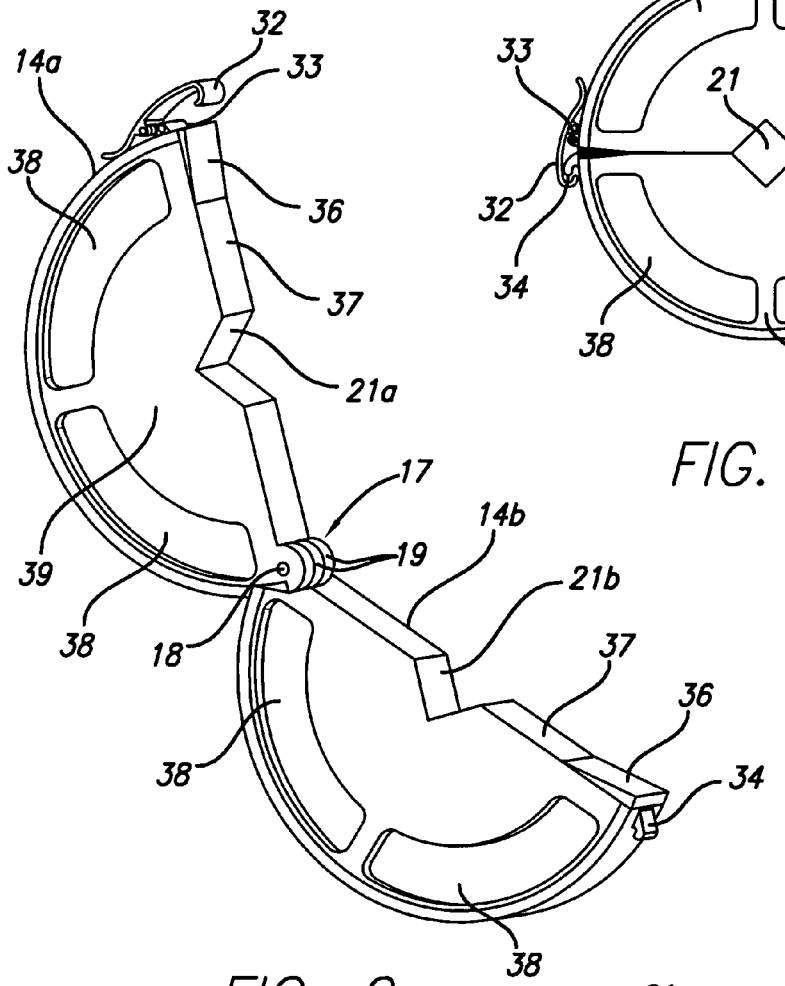
FIG. 2 is a front isometric view of one of the weight plates in the embodiment of FIG. 1 in an open position.
Figure 3:
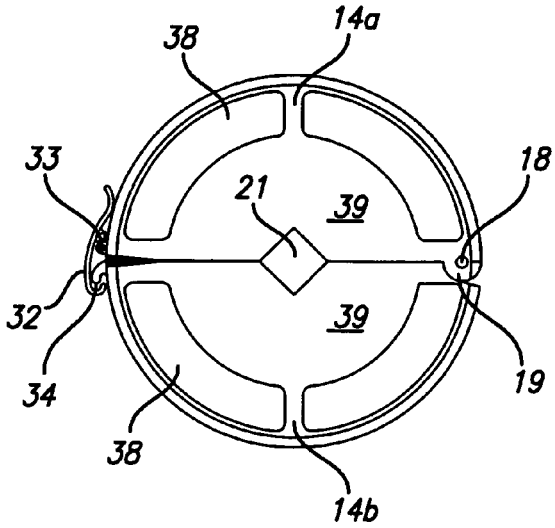
FIG. 3 is a rear elevational view of the weight plate of FIG. 2 in a closed position.
Figure 4:
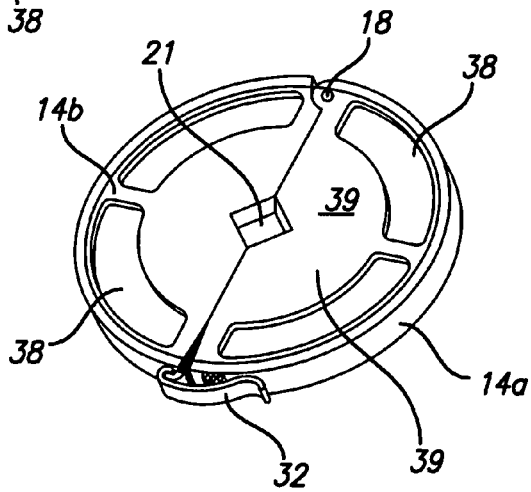
FIG. 4 is a front isometric view of the weight plate of FIG. 2 in a closed position.
Figure 5:
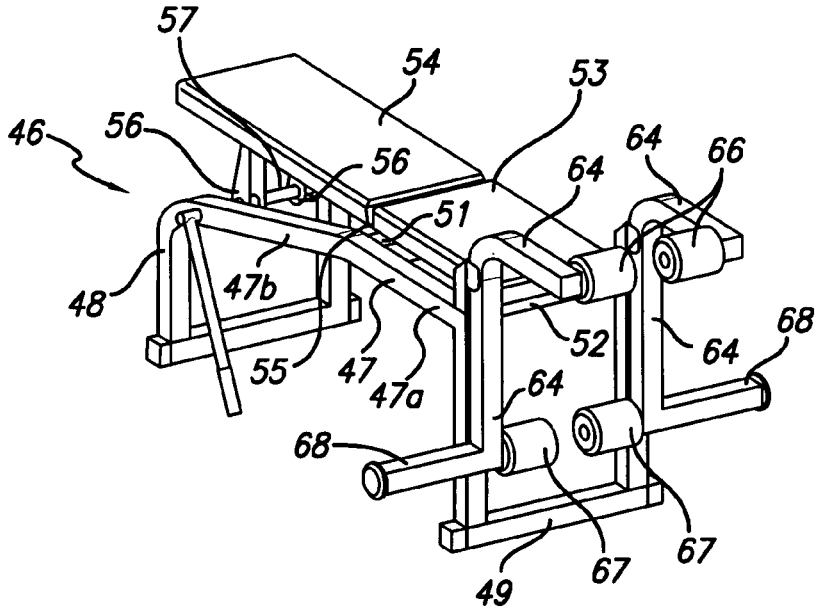
FIG. 5 is an enlarged isometric view of the adjustable bench in the embodiment of FIG. 1.

As best seen in FIGS. 2-4, each of the weight plates has two semicircular sections 14*a*, 14*b* which are hinged together at 17 for movement between open and closed positions. In the embodiment illustrated, the hinge consists of a pin 18 which passes through interleaved flanges 19 that are formed as integral parts of the plates.

Each plate has a central opening 21 through which the bar extends. The opening is formed partly in each of the two sections 14*a*, 14*b*, and when the plate is in its closed position, the walls of the opening encircle the bar. In the open position, the bar rests only in the portion 21*b* of the opening in the lower section of the plate and is free to be lifted into and out of it.

In the embodiment illustrated, both the openings 21 in the plates and the end portions 22 of the bar have a square shape, which prevents the weights from rotating on the bar and ensures that they will be oriented correctly upon return to the weight trays.

The two sections of the weight plates are held in the closed position by a clasp 32 which is mounted on one of the sections by an over-center linkage 33 and a lug 34 on the other. Resilient rubber pads 36 are mounted on the confronting edges 37 of the two sections, and arcuately extending recesses 38 are formed in the side faces 39 of the plates to facilitate handling of the plates.

Collars or flanges 41, 42 are affixed to the bar at the inner and outer ends of areas in which the weight plates are attached. In addition to preventing the plates from sliding along or falling off the bar, these flanges also serve as guides for returning the bar to the proper axial position in weight trays 13. In this regard, it will be noted that the spacing between the flanges is slightly greater than the distance between the outer surfaces 43 of the side walls of the weight trays and that the flanges are on opposite sides of the trays when the bar is in the correct axial position.

If desired, each of the weight plates can be individually retained in an axial position on the bar by a locating pin (not shown) which extends from either the weight plate or the bar and is received in the other.

Bench 12 has a supporting frame 46 with side rails 47 and legs 48, 49 at the head and foot ends of the rails. Each of the rails has a horizontal section 47*a* toward the foot of the bench and a downwardly inclined section 47*b* toward the head. Cross members 51, 52 extend between the rails at the ends of the horizontal sections.

A seat 53 is mounted in a stationary position on the horizontal section of the frame, and a backrest 54 is mounted on the inclined section for movement between raised and lowered positions. The inner end of the backrest is pivotally mounted to cross member 51 by a hinge 55, and the outer end is supported by a pair of lift arms 56. The lift arms are affixed to a shaft 57 which is rotatively mounted between the side rails of the frame. An operating handle or lever 58 is affixed to the shaft on one side of the bench and provides means for a person on the bench to raise and lower the backrest.

Figure 6:
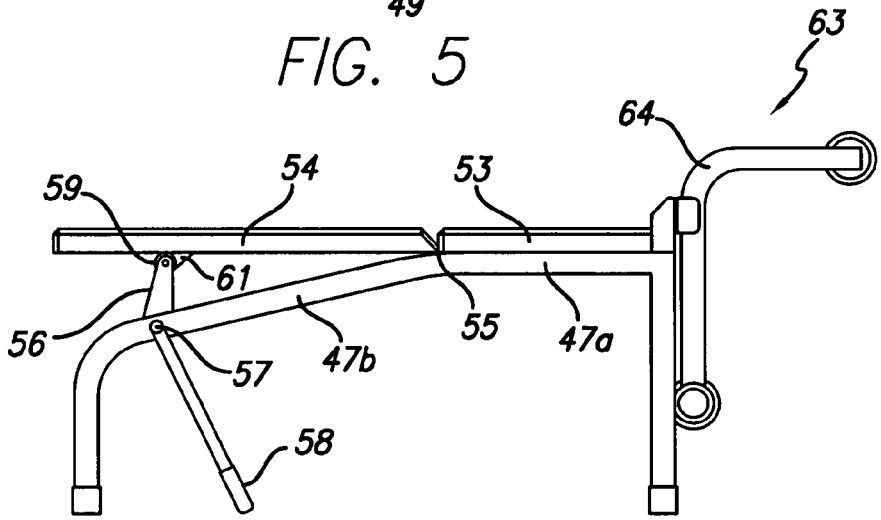
FIGS. 6 and 7 are side elevational views of the bench of FIG. 5 in raised and retracted positions.

The lift arms include rollers 59 which engage the under side of the backrest in cam-like fashion, and stops 61 on the backrest limit rotation of the arms in one direction. The backrest is brought a horizontal position by rotation of the handle in a downward direction until the rollers abut against the stops. As best seen in FIG. 6, the stops are positioned somewhat closer horizontally to the hinge than the shaft, and the arms lean back toward the stops when the backrest is in the horizontal or raised position. Consequently, the weight of the person on the bench urges the rollers against the stops and locks the backrest in the horizontal position.

Figure 7:
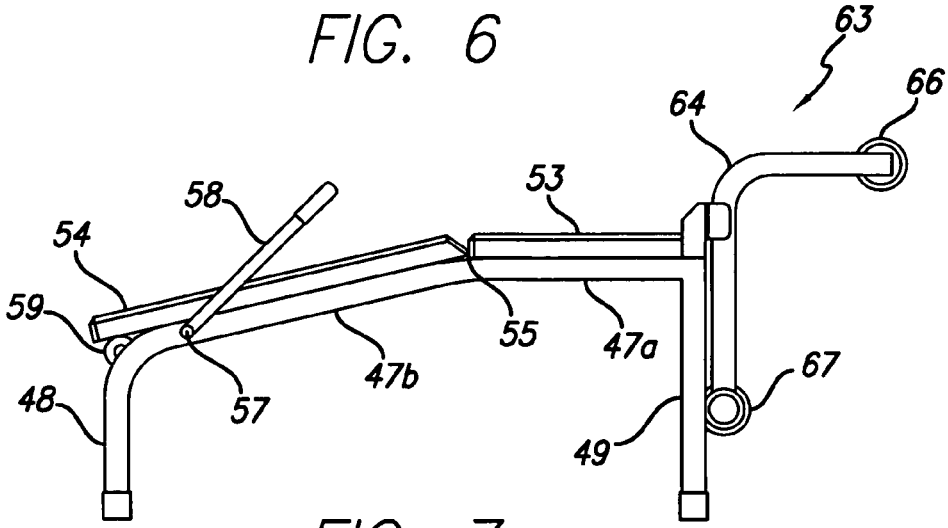

The backrest is lowered to an inclined position by rotating the handle in an upward direction as illustrated in FIG. 7. By lowering the backrest in this manner, a person can get onto and off of the bench with the bar in a relatively low position, e.g. resting on the weight stands. This makes it possible for him to do exercises such as bench presses without the help of a spotter.

A pair of individually operable leg extension bars 63 are provided at the foot of the bench. Each of these bars includes an L-shaped arm 64 which is pivotally mounted to the frame, with rollers 66, 67 extending in an inward direction at the upper and lower ends of the arms. Weight bars 68 extend in an outward direction at the lower ends of the arms in axial alignment with rollers 67.

Weight trays 69 are positioned on opposite sides of the bench near weight bars 68. Each of these trays holds a plurality of weight plates 71 in a side-by-side position for selective attachment to weight bars 68. These plates are similar to weight plates 14 and are attached to the weight bars in the same manner those plates are attached to barbell bar 16. Weight trays 69 have generally rectangular housings 72 which can also serve as footrests for a person on the bench.

Operation and use of the weightlifting system is as follows. With bar 16 resting in weight trays 13, a person wishing to do an exercise with the barbell selects the amount of weight he wants to lift by simply swinging the upper sections of the desired plates down onto the lower sections and locking them in place with clasps 32.

He can then get onto the bench, with backrest 54 in its lowered position, and position himself beneath the bar. He raises the bench to its horizontal position by pushing down on handle 58 and does his exercise. When he is done with the exercise, he returns the bar to its rest position, with the weight plates resting in the weight trays, then lifts the handle to lower the backrest so he can get out from under the bar.

For leg exercises, he attaches the desired plates 71 to each of weight bars 68 by simply swinging the upper sections of the plates down onto the lower sections and locking them in place. As noted above, the leg bars are independent of each other, and different amounts of weight can be used on the two, if desired.

To do leg extensions, a person sits on seat 53, with his upper legs over rollers 66 and his lower legs behind rollers 67, then extends and bends his legs at the knee. When he is done with the exercise, the weights will return to the trays, and because of the manner in which the plates are attached to the bars, he can change them while seated on the bench.

Figure 8:
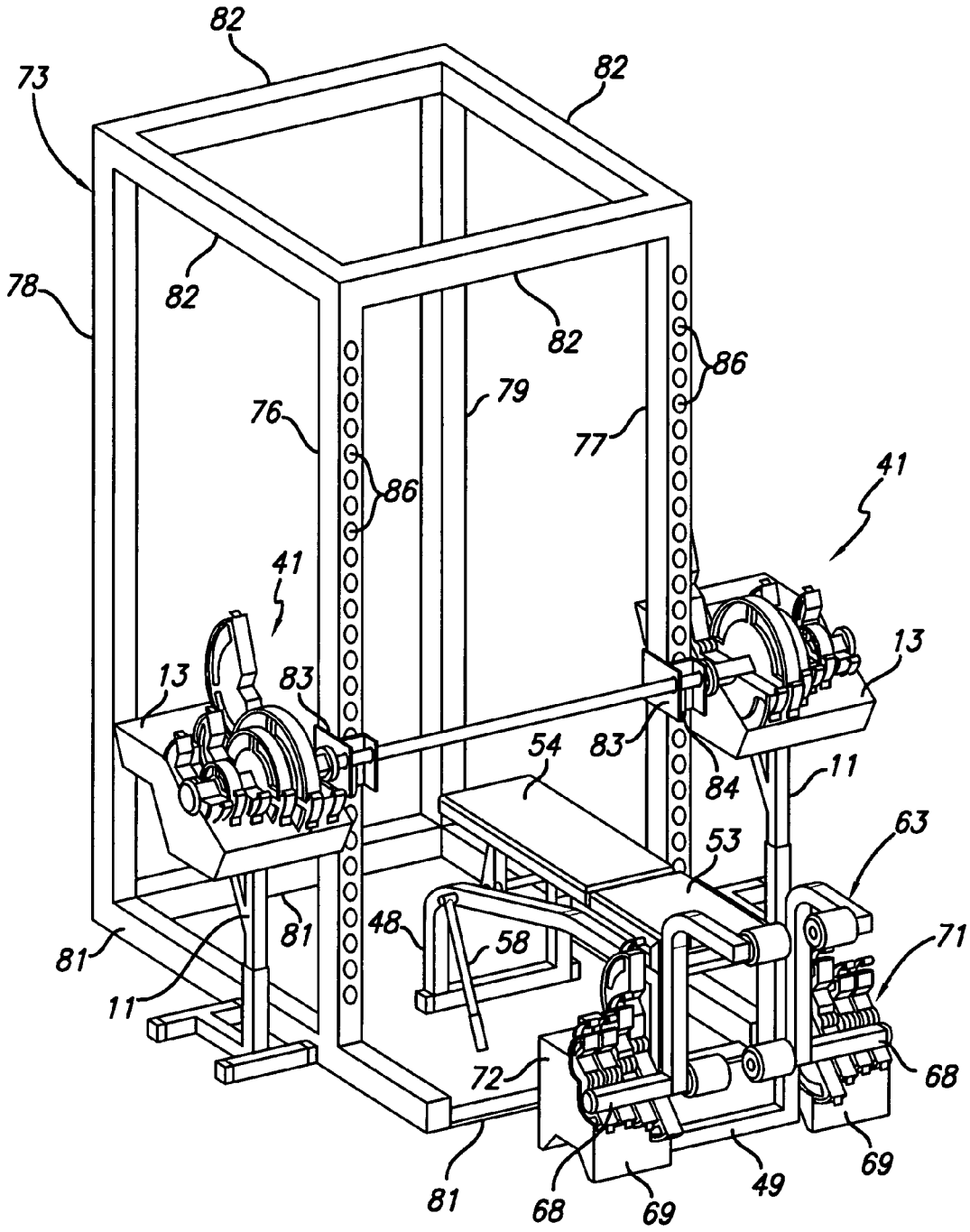
FIG. 8 is an isometric view of another embodiment of a weightlifting system incorporating the invention.

The embodiment shown in FIG. 8 is similar to the embodiment of FIG. 1, with the addition of a frame 73 which serves as a guide for the barbell. The frame has four upright members or posts 76-79 mounted on a rectangular base 81 and connected together at their upper ends by rails 82.

Guide sleeves 83 are slidably mounted on posts 76, 77 and connected to bar 16 to constrain the bar for vertical movement along the posts. In the embodiment illustrated, the bar is connected to the guides by passing the bar through aligned openings in flanges which extend rearwardly from the sleeves.

Means is provided for holding the bar in a rest position at a desired height. That means includes pins 84 which can be selectively engaged with holes 86 that spaced along the length of posts 76, 77. The pins extend from the holes, and the guide sleeves rest upon the exposed portions of the pins.

Operation and use of the embodiment of FIG. 8 is similar to that of the embodiment of FIG. 1, the only difference being the function of the guide posts and sleeves in constraining the barbell for movement in a vertical direction and in holding it at a desired rest height.

The embodiment shown in FIG. 9 is particularly suitable for doing arm curls. It has a frame 87 which includes a generally U-shaped base 88 with a pair of generally parallel legs 89 that extend along the sides of the base and a cross member 91 that extends between the legs toward the rear of the base. A pair of inclined posts 92 extend upwardly and rearwardly from the front portions of the legs, and seat 93 is mounted on the cross member. An arm rest 94 consisting of a generally rectangular panel 96 is mounted on the posts in front of the seat and is rearwardly inclined so that a person sitting on the seat can rest the backs of his upper arms on the panel. The panel is generally coplanar with the posts and can be padded, if desired.

The seat has a post 97 with a lower section 98 which is affixed to the cross member of the frame and an upper section 99 which is telescopically mounted on the lower section for adjusting the height of the seat. The seat is held at a desired height by a pin 101 which is inserted through openings 102, 103 in the two post sections.

A pair of weight stands 104 are positioned next to the legs in front of the arm rest panel. These weight stands are similar to weight stands 11, and each has a tray 106 with a plurality of weight plates 107 which are similar to weight plates 14. A bar 108 extends between the weight stands and in front of posts 92 in position to be gripped by the hands of a person sitting on the seat. Brackets 109 are mounted on the front sides of the posts for holding the bar in a rest position in which the weight plates can be attached to it.

Operation and use of the embodiment of FIG. 9 is as follows. With the bar in the rest position, the weight plates can be selectively attached to and removed from the bar as in the embodiment of FIG. 1, i.e. simply by swinging the upper sections of the desired plates down onto the lower sections and locking them in place and by unlocking the sections and swinging the upper sections away from the bar. This permits the amount of weight on the bar to be changed without having to slide plates onto and off of the bar.

The exerciser sits on seat 93 with his arms hanging down in front of arm rest panel 96. He grips the bar in his hands and swings it up and out and then down and back, with the backs of his upper arms resting against the arm rest panel. By keeping the backs of his upper arms against the panel, the exerciser is forced to do the curls correctly and is prevented from "cheating" by using the upper arms to assist in the process.

It is apparent from the foregoing that a new and improved weightlifting system which is particularly suitable for doing arm curls has been provided. While only certain presently preferred embodiments have been described in detail, as will be apparent to those familiar with the art, certain changes and modifications can be made without departing from the scope of the invention as defined by the following claims.

The invention claimed is:

1. A weightlifting system for doing arm curls, comprising: a seat for supporting a person using the system, an arm rest having an upwardly and rearwardly inclined panel positioned in front of the seat for engagement by the upper arms of a person on the seat, a pair of weight stands positioned in front and to the sides of the arm rest, a bar extending between the weight stands in position to be grasped in the hands of a person sitting on the seat with the backs of the upper arms of the person resting against the arm rest panel, and a plurality of weight plates disposed on each of the stands for selective attachment to the bar without removing the plates from the stands.

2. The system of claim 1 wherein the weight plates are formed in sections which are hinged together, and the weight stands include trays in which lower sections of the plates are received and held in upright positions beneath the bar, with an upper section of each plate being free for movement between an open position in which the upper section is swung away from the lower section and the plate is detached from the bar and a closed position in which the upper section overlies the lower section and the plate is attached to the bar.

3. The system of claim 2 wherein the weight plates have central openings of non-circular shape in which the bar is received.

4. A weightlifting system for doing arm curls, comprising: a base, a pair of posts extending upwardly from the base, an upwardly and rearwardly inclined arm rest panel mounted on the posts for engagement by the upper arms of a person using the system, a bar supported by the posts in a rest position in which the bar can be grasped in the hands of a person with the backs of the person's upper arms resting against the panel, a pair of weight stands positioned beneath opposite end portions of the bar, and a plurality of hinged weight plates resting side-by-side in upright positions in trays on the stands for selective attachment to and detachment from the bar without removing the plates from the trays.

5. The system of claim 4 wherein the posts extend upwardly and rearwardly and are generally coplanar with the arm rest panel.

6. The system of claim 4 wherein the weight plates are formed in sections which are hinged together, with lower sections of the plates positioned beneath the bar and an upper section of each plate being free for movement between an open position in which the upper section is swung away from the lower section and the plate is detached from the bar and a closed position in which the upper section overlies the lower section and the plate is attached to the bar.

7. A weightlifting system for doing arm curls, comprising: a frame having a generally U-shaped base with a pair of legs and a cross member extending between the rear portions of the legs, a seat mounted on the cross member for supporting a person using the system, a pair of posts extending upwardly and rearwardly from the front portions of the legs, an arm rest panel mounted on the posts in front of the seat for engagement by the upper arms of a person on the seat, a pair of weight stands positioned next to the legs in front of the arm rest panel, a bar extending between the weight stands in position to be grasped in the hands of a person sitting on the seat with the backs of the upper arms of the person resting against the arm rest panel, and a plurality of hinged weight plates resting side-by-side in upright positions in trays on the stands for selective attachment to and detachment from the bar without removing the plates from the trays.

8. The system of claim 7 including brackets affixed to the posts for supporting the bar in a rest position.

9. The system of claim 7 wherein the weight plates are formed in sections which are hinged together, with lower sections of the plates positioned beneath the bar and an upper section of each plate being free for movement between an open position in which the upper section is swung away from the lower section and the plate is detached from the bar and a closed position in which the upper section overlies the lower section and the plate is attached to the bar.

10. The system of claim 7 wherein the seat includes a post having a lower section affixed to the cross member, an upper section telescopically mounted to the lower section, and means for selectively locking the post sections in different positions to adjust the height of the seat.

11. A weightlifting system for doing arm curls, comprising: an upwardly and rearwardly inclined arm rest panel adapted to receive the upper arms of a person positioned to the rear of the panel, a pair of weight stands positioned in front of and toward opposite sides of the arm rest panel, a bar extending between the weight stands in position to be grasped by the hands of the person with the backs of the person's upper arms resting against the panel, and a plurality of weight plates disposed on each of the stands for selective attachment to the bar without removing the plates from the stands.

12. The system of claim 11 wherein the weight plates are formed in sections which are hinged together, and the weight stands include trays in which lower sections of the plates are received and held in upright positions beneath the bar, with an upper section of each plate being free for movement between an open position in which the upper section is swung away from the lower section and the plate is detached from the bar and a closed position in which the upper section overlies the lower section and the plate is attached to the bar.

13. A weightlifting system for doing arm curls, comprising: a seat for supporting a person using the system, a pair of rearwardly inclined posts positioned in front of the seat, a pair of weight stands positioned next to the posts, a bar extending between the weight stands in position to be grasped in the hands of a person sitting on the seat, means carried by the posts for supporting the bar in a rest position, and a plurality of hinged weight plates resting side-by-side in upright positions in trays on the stands for selective attachment to and detachment from the bar without removing the plates from the trays when the bar is in the rest position.

14. The system of claim 13 wherein the weight plates are formed in sections which are hinged together, with lower sections of the plates positioned beneath the bar and an upper section of each plate being free for movement between an open position in which the upper section is swung away from the lower section and the plate is detached from the bar and a closed position in which the upper section overlies the lower section and the plate is attached to the bar.

15. The system of claim 14 wherein the weights have central openings formed partly in each of the two sections, and end portions of the bar are received in the portions of the openings in the lower sections of the plates when the bar is in the rest position.

16. The system of claim 6 wherein the weights have central openings formed partly in each of the two sections, and the end portions of the bar are received in the portions of the openings in the lower sections of the plates when the bar is in the at rest position.

* * * * *